US005362259A

United States Patent [19]

Bolliger

[11] Patent Number: 5,362,259

[45] Date of Patent: Nov. 8, 1994

[54] GROUND CONDUCTOR TERMINAL

[75] Inventor: Roman Bolliger, Allschwil, Switzerland

[73] Assignee: Woertz AG, Muttenz, Switzerland

[21] Appl. No.: 16,257

[22] Filed: Feb. 11, 1993

[30] Foreign Application Priority Data

Feb. 18, 1992 [CH] Switzerland ..... 479/92-0

[51] Int. Cl.[5] ..... H01R 9/26

[52] U.S. Cl. ..... 439/716; 439/532

[58] Field of Search ..... 439/712, 713, 714, 715, 439/716, 717, 94, 532

[56] References Cited

U.S. PATENT DOCUMENTS 4,073,563 2/1978 Bailey et al. ..... 439/532
4,921,445 5/1990 Herbert ..... 439/532
5,022,873 6/1991 Köllman ..... 439/716
5,174,767 12/1992 Diekmann et al. ..... 439/716
5,192,227 3/1993 Bales ..... 439/532

*Primary Examiner*—Larry I. Schwartz
*Assistant Examiner*—Hien D. Vu
*Attorney, Agent, or Firm*—Watson, Cole, Grindle & Watson

[57] ABSTRACT

A ground conductor terminal includes a terminal body containing two internal terminals, a bent plate which at one end is in electrical contact with the terminals, and a generally U-shaped spring which extends behind a second end of the bent plate at the base of the ground conductor terminal and which can snap fit onto a mounting rail so as to detachably connect the ground conductor terminal to the mounting rail.

3 Claims, 1 Drawing Sheet

GROUND CONDUCTOR TERMINAL

BACKGROUND OF THE INVENTION

1. Field of the Invention

The present invention relates to a ground conductor terminal which can be mounted in snap-lock fashion on and/or removed from a mounting rail shaped preferably as a protective conductor bus bar, the ground conductor terminal having a terminal body made of a non-conducting material and terminals which are integrated therein that communicate with an electrically conducting plate that in turn can be connected to the mounting rail.

2. The Prior Art

In known ground conductor terminals of the noted kind which can be snapped on a protective conductor bus bar, a good electrical transition contact from ground conductor terminal to the mounting rail is required for a reliable connection. Due to the high short circuit test currents, such a connection has been accomplished to date by means of screws.

The tightening or loosening of these contact screws does not correspond obviously to the meaning of a snap attachment and thus renders a fast, uncomplicated mounting of the ground conductor terminals on the mounting rail difficult.

The object of the present invention is to design a ground conductor terminal in such a manner that, together with a snap-on process onto a mounting rail, the terminal also guarantees a reliable electrical connection between ground conductor terminal and mounting rail.

SUMMARY OF THE INVENTION

This problem with a ground conductor terminal of the kind defined above is solved by extending the plate, which conductively communicates with the terminals, down to the base of the terminal body and by bending down region-by-region at the bottom end, in order to form contact surfaces which are intended to rest on the mounting rail, and by providing spring means in the terminal body in order to press the terminal with the contact surfaces of the conducting plate against the mounting rail.

Preferably the spring means is in the form of a substantially U-shaped clamp-like bow whose connecting leg extends behind the bent end regions of the conducting plate and abuts the plate, whereas flexible, downwardly protruding legs are bent slightly inwardly in order to reach from the side under the contact surfaces of the mounting rail when the terminal is mounted on the mounting rail.

In such an embodiment the end of at least one of the flexible bow legs can exhibit an outwardly-protruding extension which facilitates the disconnection of the snap-lock. This leg extension can include an opening in order to apply an operating lever (tool, e.g. screwdriver).

An especially preferred embodiment of the ground conductor terminal is characterized by the fact that the back side of the bent end regions of the conducting plate has elevations which are made preferably of the plate material and against which the connecting leg of the bow abuts and thus can extend freely between the formed elevations, thus supporting the clamping action of the spring.

Thus, the invention relates to a spring pressure ground conductor terminal with a screwless snap-on mechanism in order to attach it to a mounting rail.

The invention will be explained in somewhat greater detail in the following with the aid of the embodiment shown in the drawings.

DETAILED DESCRIPTION OF THE PREFERRED EMBODIMENT

Figure 1:
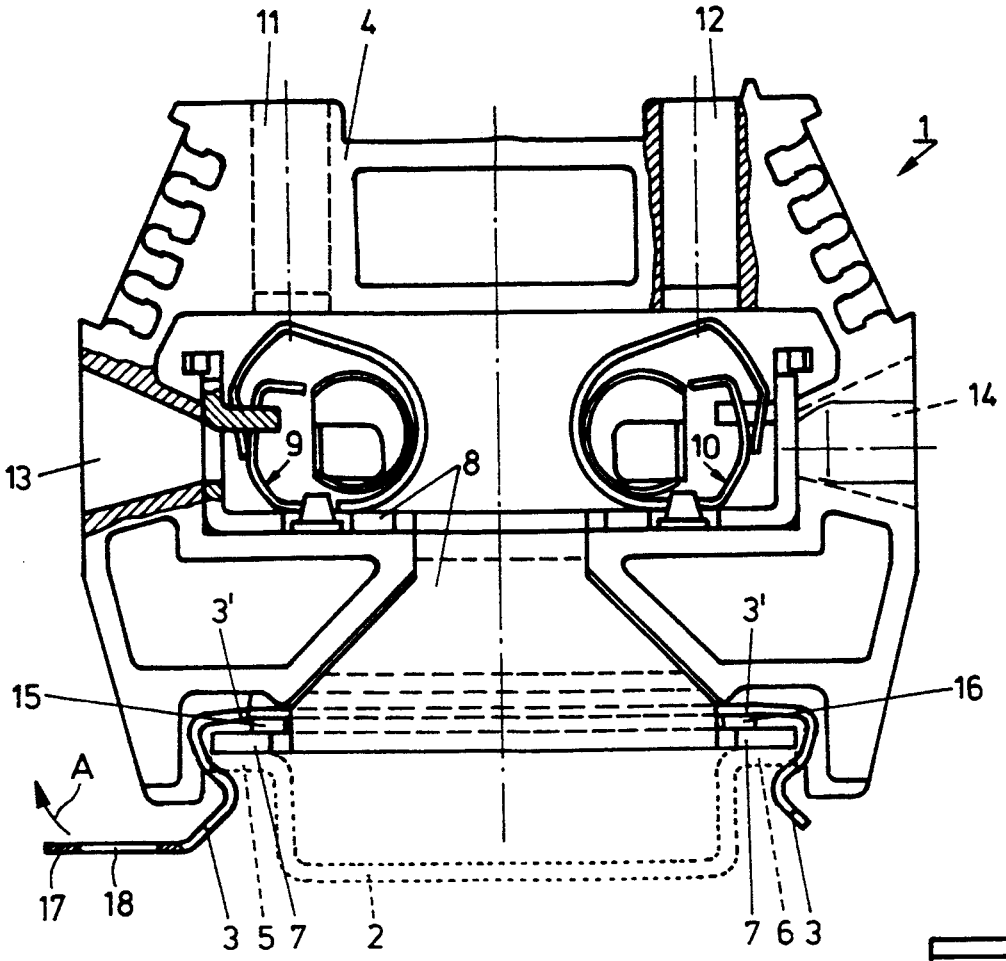
FIG. 1 is a front view of a ground conductor terminal according to the invention, partially broken away.
Figure 3:
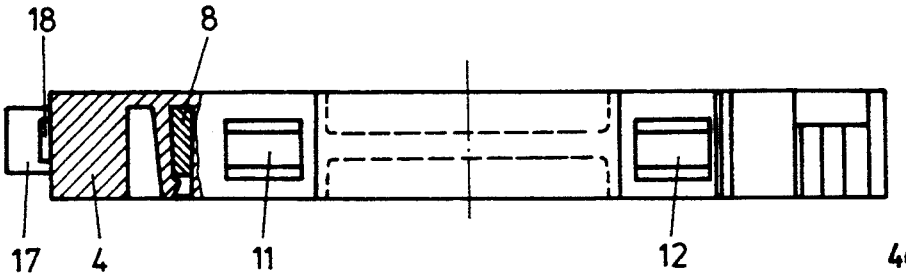
FIG. 3 is a top plan view of the ground conductor terminal as seen in FIG. 1, partially broken away.
Figure 2:
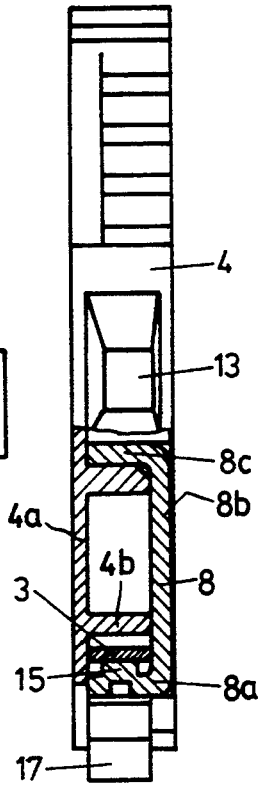
FIG. 2 is a view from the left side of the ground conductor terminal shown in FIG. 1, also partially broken away.

The ground conductor terminal 1 shown in FIGS. 1–3 is capable of being snapped onto a mounting rail 2 (protective conductor bus bar). The ground conductor terminal includes a terminal body 4 which defines a planar portion 4*a* and a transversely extending bottom flange 4*b*. A bow-shaped spring 3 is provided at the base portion of the terminal body 4, which is made of a non-conducting material and which extends under the side flanges 5, 6 of the mounting rail 2 and thus presses the ground conductor terminal 1 against the mounting rail 2.

The spring 3 extends behind (above as seen in FIG. 2) a base portion 8*a* of the electrically-conducting plate 8, this base portion 8*a* extending at a right angle to the middle portion 8*b* that extends downwardly from an upper portion 8*c* that is in electrical contact with the two terminals 9,10 in the central region of the terminal body 4. The middle portion 8*b* extends in parallel with the planar portion 4*a* of the terminal body. The screwless terminals 9, 10 can be downwardly moved by a tool inserted through openings 11,12 in the top of terminal body so as to permit conductors to be inserted into side openings 13,14 and thereafter clamped with removal of the tool. In a similar fashion clamped conductors can be released.

Thanks to the spring 3, which rests on the back side of the bent base portion 8a of the plate 8, the ground conductor terminal 1 is pressed with excellent transition contact on the mounting rail 2 when the ground conductor terminal 1 is snapped onto the mounting rail 2.

To ensure that the connecting leg 3' of the spring 3 abuts the base portion 8*a* of the plate 8, parts of this base portion 7 bulge toward the top or exhibit upwardly-projecting elevations 15, 16, against which the spring reliably comes to rest and can extend freely inbetween.

One leg of spring 3 provides an outwardly-projecting extension 17 which allows the snap connection to be disconnected in a simple manner and the ground conductor terminal 1 to be removed from the mounting rail 2. The spring extension 17 is provided with an opening 18 which allows a lever (e.g. a screwdriver) to be inserted in order to detach the spring in a simple manner by extending the extension 17 away from the flange 5 of the mounting rail 2 as shown by arrow A in FIG. 1.

What is claimed is:

1. A ground conductor terminal which can be removably mounted by snap-lock connection onto a mounting rail designed as a protective bus bar and having oppositely directed side flanges, said ground conductor terminal comprising;

a terminal body made of a non-conducting material and defining a planar portion and a bottom flange which extends transversely to said planar portion, terminals which are integrated in said terminal body, an electrically-conducting plate which is in electrical contact with said terminals and which is connectable with said mounting rail, said electrically-conducting plate defining a planar middle portion which extends in parallel with said planar portion of said terminal body and a bottom flange which extends transversely to said planar middle portion and which, when said planar portion of said terminal body and said planar middle portion of said electrically-conducting plate are vertically oriented, extends beneath said bottom flange of said terminal body, said bottom flange of said electrically-conducting plate defining it upwardly-extending spaced-apart elevations which extends towards said bottom flange of said terminal body, and spring means for pressing said bottom flange of said electrically-conducting plate against the mounting rail, said spring means comprising a substantially U-shaped clamp-like bow having a connecting leg which extends horizontally above the bottom flange of the electrically-conducting plate and in contact with and extending steel between said upwardly-extending, spaced-apart elevations, and flexible, downwardly-extending legs which are bent slightly inwardly in order to extend around said oppositely-directed side flanges of the mounting rail, said elevations supporting the clamping action of said spring means.

2. A ground connector terminal as claimed in claim 1, wherein an end of at least one of the flexible legs of the spring means provides an outwardly-protruding extension which facilitates disconnection with the mounting rail.

3. A ground conductor terminal as claimed in claim 2, wherein said outwardly-protruding extension defines an opening in which an operating lever can be inserted.

* * * * *